US006778146B2

(12) United States Patent
Nakagawa et al.

(10) Patent No.: US 6,778,146 B2
(45) Date of Patent: Aug. 17, 2004

(54) SATELLITE BROADCAST RECEPTION CONVERTER SUITABLE FOR MINIATURIZATION

(75) Inventors: Masashi Nakagawa, Fukushima-ken (JP); Kazuhiro Sasaki, Fukushima-ken (JP); Yuanzhu Dou, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 80 days.

(21) Appl. No.: 10/247,870

(22) Filed: Sep. 20, 2002

(65) Prior Publication Data

US 2003/0058183 A1 Mar. 27, 2003

(30) Foreign Application Priority Data

Sep. 21, 2001 (JP) ..... 2001-289731
Sep. 21, 2001 (JP) ..... 2001-289791

(51) Int. Cl.[7] ..... H01Q 13/00
(52) U.S. Cl. ..... 343/786; 343/785
(58) Field of Search ..... 343/786, 772, 343/775, 779, 783, 784, 785; 333/21 A, 26

(56) References Cited

U.S. PATENT DOCUMENTS 6,043,789 A * 3/2000 Suzuki et al. ..... 343/786
6,426,729 B2 * 7/2002 Yoshida et al. ..... 343/786
6,437,753 B2 * 8/2002 Yuanzhu ..... 343/772
6,445,260 B1 * 9/2002 Miyazaki et al. ..... 333/21 A

FOREIGN PATENT DOCUMENTS

| | | | |
|---|---|---|---|
| DE | 42 07 503 | 9/1993 | |
| EP | 0 899 812 | 3/1999 | |
| JP | 10126114 | 5/1998 | |
| JP | 2001-57507 | 2/2001 | ..... H01Q/13/02 |

* cited by examiner

*Primary Examiner*—Hoang V. Nguyen
(74) *Attorney, Agent, or Firm*—Brinks Hofer Gilson & Lione

(57) ABSTRACT

In a satellite broadcast reception converter, probes are equipped in a circular hole formed in a first circuit board, and plural fixing holes are formed around the circular hole. Snap pawls are formed at open ends of the waveguides formed of sheet metal. The respective snap pawls are inserted in the fixing holes of the first circuit board so as to project to the back surface side of the first circuit board, and the fixing holes of the short caps are snapped into the snap pawls. A dielectric feeder of synthetic resin supported on each waveguide has a first split body with radiation portion projected from the open end of each waveguide and a second split body having a phase converter fixed in the waveguide. The first and second split bodies are unified by inserting a projection equipped to the second split body into a through hole formed at the center of the first split body.

10 Claims, 15 Drawing Sheets

SATELLITE BROADCAST RECEPTION CONVERTER SUITABLE FOR MINIATURIZATION

BACKGROUND OF THE INVENTION

1. Field of the Invention

The present invention relates to a satellite broadcast reception converter for receiving electric waves transmitted from a satellite, and particularly to a satellite broadcast reception converter suitable for receiving circularly polarized electric waves transmitted from a satellite.

2. Description of the Related Art

A satellite broadcast reception converter mounted in an outdoor antenna device is equipped with a waveguide having a hollow structure to which electric waves transmitted from a satellite are incident, a probe disposed at a predetermined position in the waveguide, a short cap for reflecting electric waves propagating in the waveguide to make the probe detect the electric waves, a circuit board having a processing circuit for performing appropriate processing (amplification, frequency conversion, etc.) on signals detected by the probe, etc. and the circuit board is usually covered by a shield case.

There has been hitherto known one of such satellite broadcast reception converters in which a waveguide and a shield case are integrally formed by aluminum die casting and a circuit board and a short cap are fixed in the shield case. In this case, a probe is formed on the circuit board by pattern formation, and if the short cap is fixed to the shield case by plural screws after the circuit board and the short cap are successively installed in the shield case, the circuit board could be pinched and fixed between the shield case and the short cap.

Further, in a satellite broadcast reception converter mounted on an outside antenna device for example when a right-handed circularly polarized or left-handed circularly polarized electric wave transmitted from a satellite is received, it is necessary to convert the circularly polarized wave incident into the waveguide to a linearly polarized wave in the phase converter and couple the linearly polarized wave to the probe for reception.

Still further, there has been also known a satellite broadcast reception converter in which a waveguide having a horn portion is formed of alloy of aluminum, zinc, etc. by die casting and then a phase converter called as a ridge is integrally formed on the inner wall surface of the waveguide and a circularly polarized wave incident from the horn portion into the waveguide is converted to a linearly polarized wave by the ridge. That is, the circularly polarized wave corresponds to a polarized wave having the rotating composite vector between two linearly-polarized waves that are equal in amplitude and have a phase difference of 90 degrees therebetween. Therefore, when the circularly-polarized wave passes through the ridge, the phase difference of 90 degrees is set to zero, and thus it is converted to the linearly polarized wave.

However, in the conventional satellite broadcast reception converter described above, the horn portion having desired aperture diameter and length is integrally formed at the tip of the waveguide, and the ridge having desired length and extending in the axial line direction is integrally formed on the inner wall surface of the waveguide. Therefore, not only the waveguide must be designed to be long in the axial line direction and thus miniaturization thereof is disturbed, but also the ridge serving as the phase converter is designed in an under-cut shape to make and thus a metal mold for die casting is complicated. As a result, the manufacturing cost is increased.

Therefore, there has been recently proposed a satellite broadcast reception converter in which a dielectric feeder achieved by integrally forming a radiation portion and a phase converter is used, the radiation portion is projected forwardly from the open end of a waveguide and the phase converter inserted and fixed in the waveguide is intersected to a probe at an angle of about 45 degrees. In this satellite broadcast reception converter, when a circularly polarized wave transmitted from a satellite is incident from the radiation portion of the dielectric feeder, the circularly polarized wave is converted to a linearly polarized wave in the phase converter while propagating in the dielectric feeder, and the linearly polarized wave goes into the deep portion of the waveguide and coupled to the probe.

Accordingly, according to the satellite broadcast reception converter using such a dielectric feeder, it is unnecessary to form a horn portion and a ridge (phase converter) integrally with a waveguide, so that the shape of the waveguide is simplified and the manufacturing cost can be reduced. In addition, the phase difference to the linearly polarized wave is large even when the overall length of the dielectric feeder is set to a relatively short value, the overall length of the waveguide itself can be shortened.

According to the conventional satellite broadcast reception converters thus constructed, the waveguide and the shield case are integrally formed by using aluminum die casting, and the circuit board and short cap are fixed in the shield case by using the plural screws. Therefore, the angularity between the probe pattern-formed on the circuit board and the axial line of the waveguide can be kept, and electric waves propagating in the waveguide can be surely detected. However, plural screws are required to fix the circuit board and the short cap, and also a subsequent step of coating adhesive agent to prevent loosening of the screws is needed. Therefore, the number of parts and the number of working steps are increased, which greatly causes rise-up of the manufacturing cost of the satellite broadcast reception converter.

In the satellite broadcast reception converter using the dielectric feeder, there is a merit that the manufacturing cost can be reduced and it can be miniaturized because a waveguide having a simple shape and a short length is available, however, it has some problem. That is, although the dielectric feeder is formed by injection-molding synthetic resin material, occurrence of surface sink and bubbles in synthetic resin is generally intensified when it is contracted as the volume (volumetric capacity) thereof increases. Therefore, high dimensional precision is not achievable with the dielectric feeder which is achieved by integrally forming a radiation portion and a phase converter like the prior art described above. Particularly when polyethylene (PE) which is low in price and has a low dielectric dissipation factor is used as the material of the dielectric feeder, there is a problem that the contraction after the injection molding is large and occurrence of bubbles is remarkable, so that the dimensional precision of each part of the dielectric feeder is extremely lowered, and the reception efficiency of electric waves transmitted from a satellite is lowered.

SUMMARY OF THE INVENTION

The present invention has been implemented in view of the foregoing situation of the prior arts, and has an object to provide a satellite broadcast reception converter in which a waveguide and a short cap can be simply fixed to a circuit board having a probe, and also which is suitable for reduction of the manufacturing cost and miniaturization and can enhance the dimensional precision of a dielectric feeder.

In order to attain the above object, according to a first aspect of the present invention, there is provided a satellite broadcast reception converter characterized by comprising a circuit board having a probe, at least one waveguide formed of sheet metal disposed vertically to the circuit board and at least one short cap designed to have a bottom through which the open end of the waveguide is closed, wherein snap pawls formed at the open end of the waveguide are inserted into fit holes formed in the circuit board and the short cap is fixedly fitted to the snap pawls to pinch the circuit board between the waveguide and the short cap.

According to the satellite broadcast reception converter thus constructed, the circuit board can be pinched and fixed by the waveguide and the short cap through a simple work of fixedly fitting the short cap to the snap pawls by utilizing the characteristic of springs (spring elasticity) of the waveguide formed of sheet metal. Therefore, the number of parts and the number of working steps can be greatly reduced, so that the manufacturing cost of the satellite broadcast reception converter can be reduced.

In the above construction, it is preferable that the short cap is soldered to an earth pattern formed on the circuit board. In this case, if the short cap is fixedly fitted to the snap pawls under the state that cream solder is coated on the earth pattern in advance, then the short cap could be easily soldered to the earth pattern by melting the cream solder in a reflow furnace.

Further, in the above construction, parallel portions extending in the axial line direction of the waveguide are formed at four confronting positions on the peripheral surface of the waveguide, and a snap pawl is extensively equipped to the top of each parallel portion, whereby each snap pawl of the waveguide can be inserted into the corresponding fitting hole of the circuit board with no rattle, and the relative positioning between the waveguide and the probe can be surely performed.

Still further, in the above construction, it is preferable that the circuit board and the short cap are covered by the shield case, the waveguide is inserted through a through hole formed in the shield case and projected to the outside and also the circuit board is fixed in the shield case. When the waveguide to which high dimensional precision is required is separated from the shield case as described above, the management of the dimensional precision of the waveguide can be enhanced.

Still further, in the above construction, it is preferable that the shield case is formed of sheet metal, and support portions are formed at the peripheral edge of the through hole formed in the shield case by bending the shield case. This construction enables the peripheral surface of the waveguide inserted in the through hole to be surely supported by the support portions.

In order to attain the above object, according to a second aspect of the present invention, there is provided a satellite broadcast reception converter characterized by comprising at least one waveguide that is closed at one end thereof and opened at the other end thereof, at least one probe projecting in the center axis direction of the waveguide and at least one dielectric feeder that is supported by the waveguide and formed of synthetic resin, wherein the dielectric feeder comprises a first split body having a radiation portion projecting from the open end of the waveguide and a second split body having a phase conversion portion fixed in the waveguide, and a projection equipped to the second split body is inserted in a through hole formed at the center portion of the first split body to unify the first split body and said second body into one body.

According to the satellite broadcast reception converter thus constructed, the dielectric feeder is constructed by the unified first and second split bodies which are separated from each other. Therefore, the volume (volumetric capacity) of each of the first and second split bodies as a single body is reduced, so that occurrence of surface sink and bubbles can be suppressed. In addition, the dielectric feeder is divided at the portion at which the through hole and the projection are jointed to each other, and the dividing face is located at a position far away from the center of the first split body at which the electric field intensity is largest, so that an electrical adverse effect caused by the division can be suppressed.

In the above construction, it is preferable that the second split body is equipped with an impedance converter which is narrowed in an arcuate shape from the open end of the waveguide to the phase converter, the projection is equipped to an end face of the impedance converter and the first and second split bodies are jointed to each other at the end face of the impedance converter. By providing the impedance converter as described above, the reflection components of electric waves propagating from the radiation portion through the impedance converter to the phase converter can be greatly reduced. In addition, the phase difference to the linearly polarized wave is large even when the length of the portion extending from the impedance converter to the phase converter is reduced, so that the overall length of the waveguide can be greatly reduced.

In this case, the projection may be strongly engaged with the through hole, however, it is preferable that an engaging projection is formed on the inner wall surface of the through hole, and an engaging recess portion is formed on the outer wall surface of the projection, the engaging projection and the engaging recess portion being snap-jointed to each other. By using such snap-joint, even when there is some dimensional dispersion between the projection and the through hole, the projection and the through hole can be simply and surely jointed to each other. At this time, it is preferable that representing the length from the rear end face of said radiation portion to said engaging projection by A and representing the length from the end face of the impedance converter to the engaging recess portion by B, A and B are set to satisfy the relation of A>B because the engaging projection and the engaging recess portion can be surely snap-jointed to each other with no rattle.

In the above construction, it is preferable that the radiation portion is designed in a conical shape which forwardly expands from the open end of the waveguide like a horn, and the end face of the impedance converter is jointed to the rear end face of the radiation portion. With this construction, the dividing face vertical to the travel direction of the electric waves propagating in the dielectric feeder is reduced, so that the reflection of the electric waves at the dividing face can be reduced.

DETAILED DESCRIPTION OF THE PREFERRED EMBODIMENTS

Preferred embodiments according to the present invention will be described hereunder with reference to the drawings.

Figure 1:
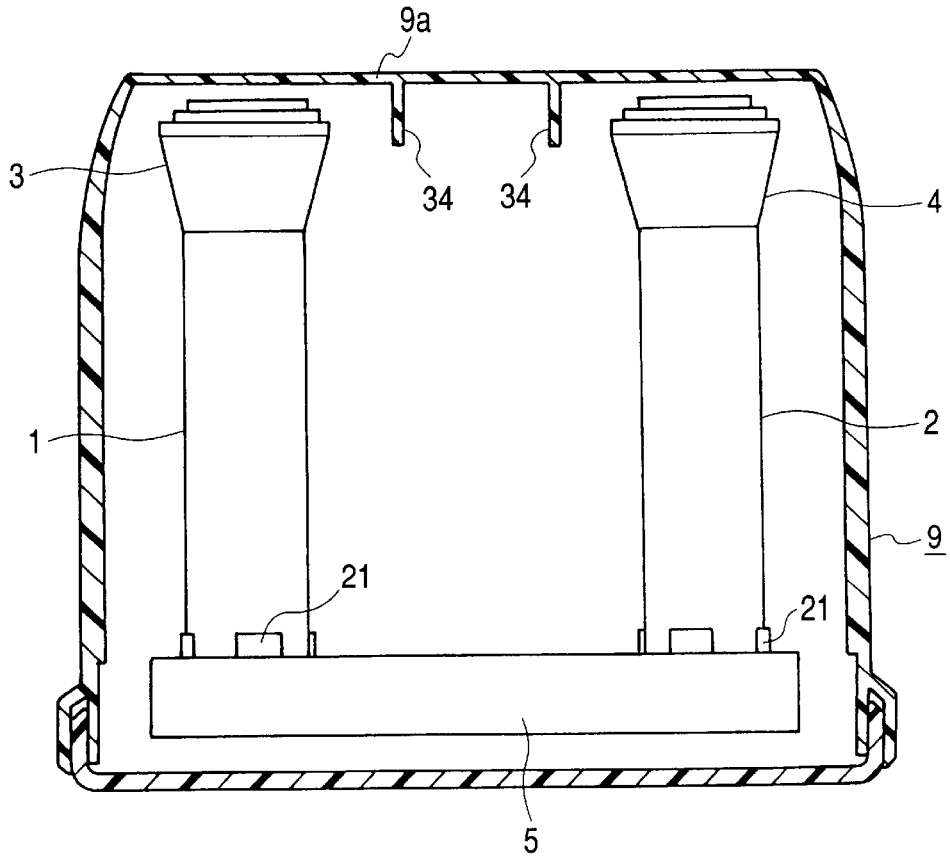
FIG. 1 is a cross-sectional view showing a satellite broadcast reception converter according to an embodiment.
Figure 2:
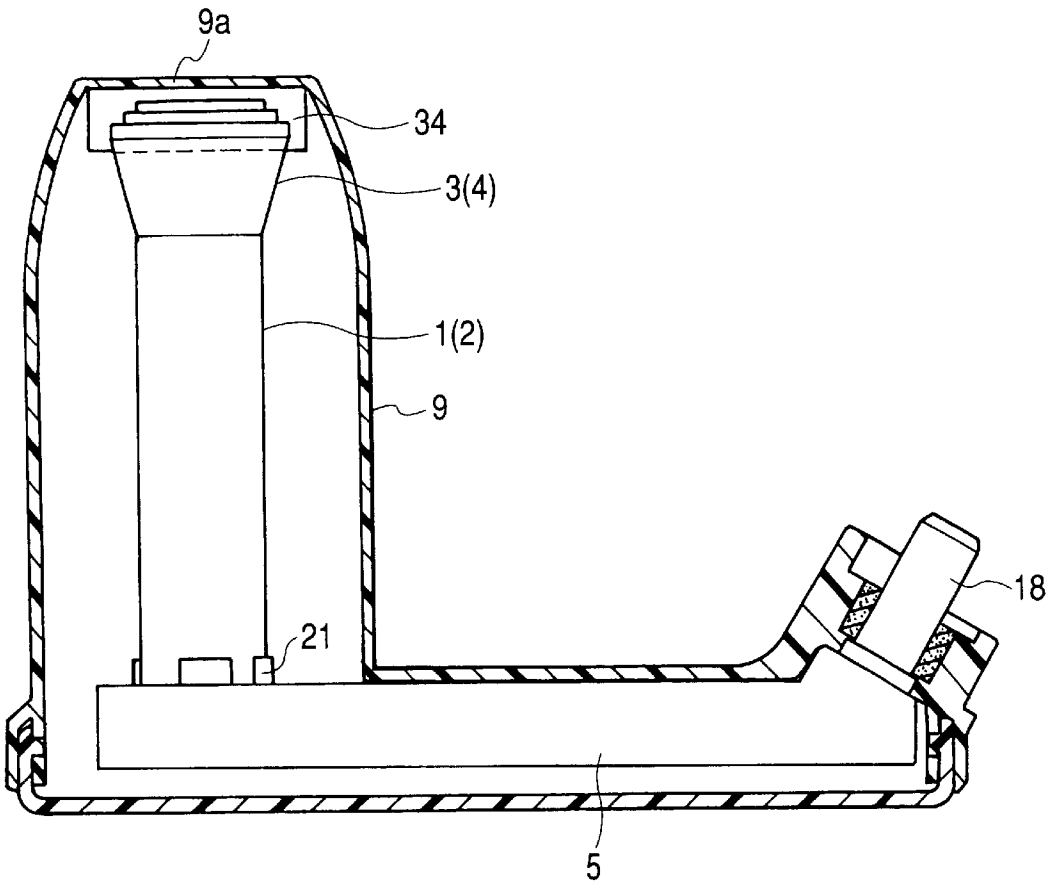
FIG. 2 is a cross-sectional view showing the satellite broadcast reception converter which is taken from another side.
Figure 3:
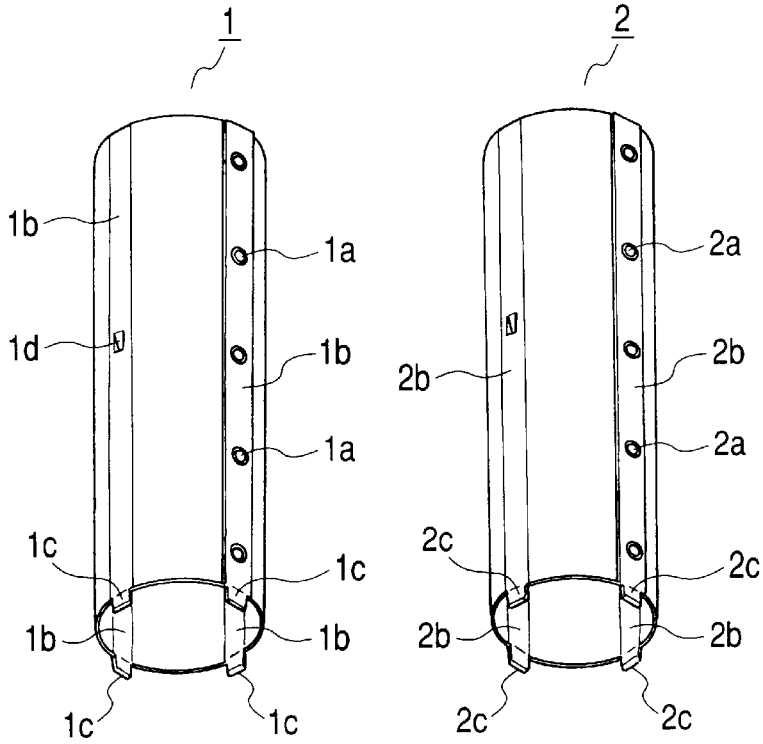
FIG. 3 is a perspective view showing a waveguide.
Figure 4:
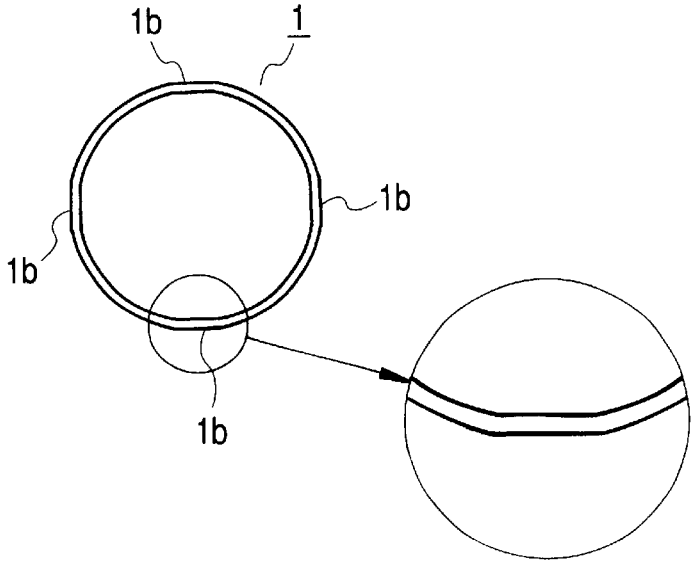
FIG. 4 is a front view of the waveguide.
Figure 5:
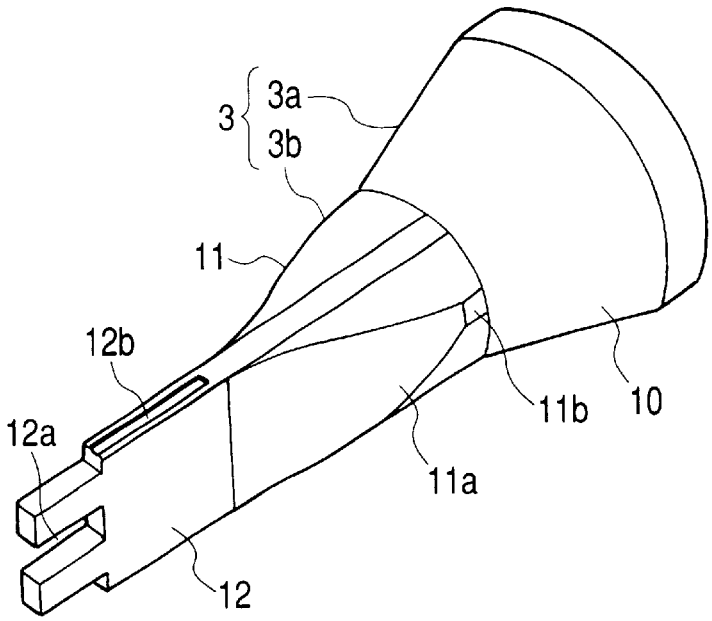
FIG. 5 is a perspective view showing a dielectric feeder.
Figure 6:
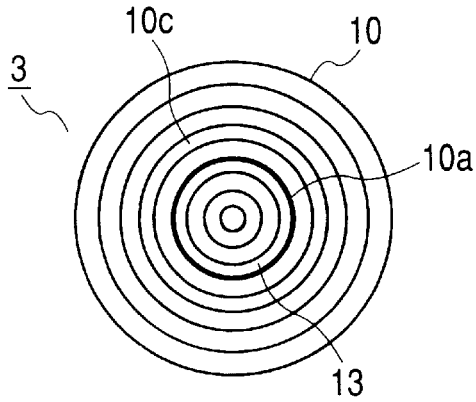
FIG. 6 is a front view showing the dielectric feeder.
Figure 7:
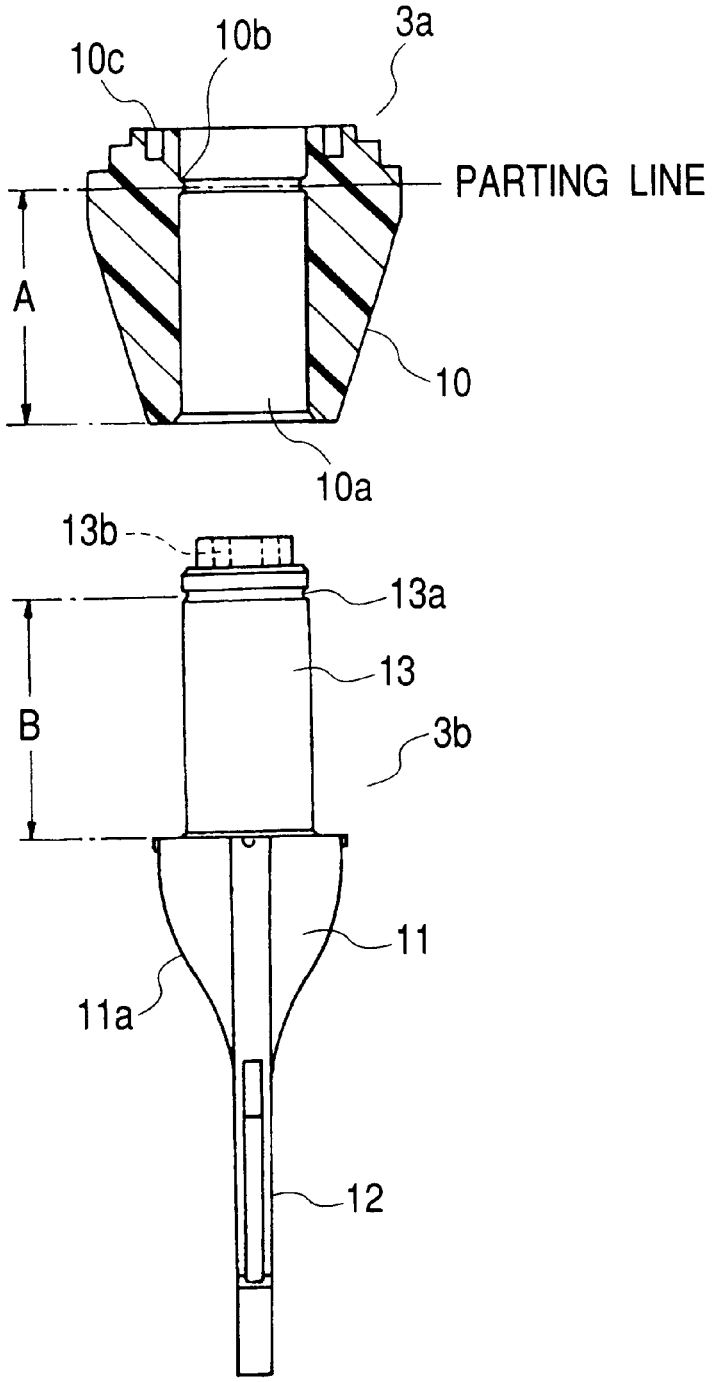
FIG. 7 is an exploded view showing the dielectric feeder.
Figure 8:
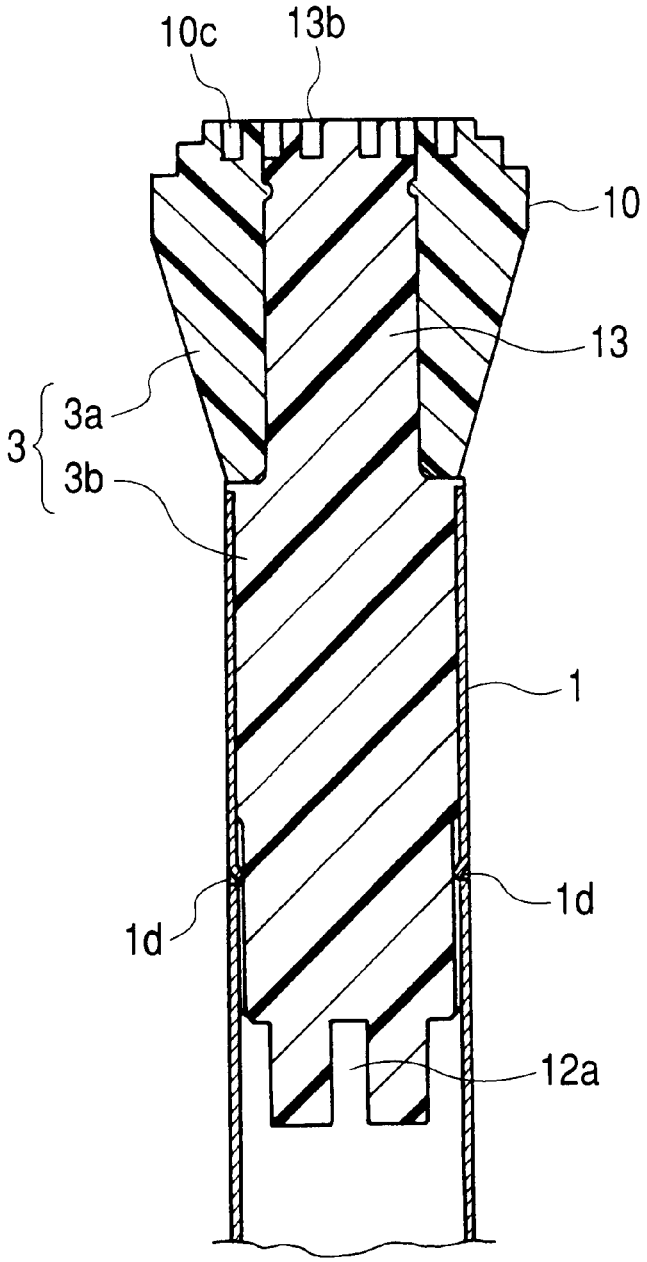
FIG. 8 is a diagram showing a state that the dielectric feeder is fixed to the waveguide.
Figure 9:
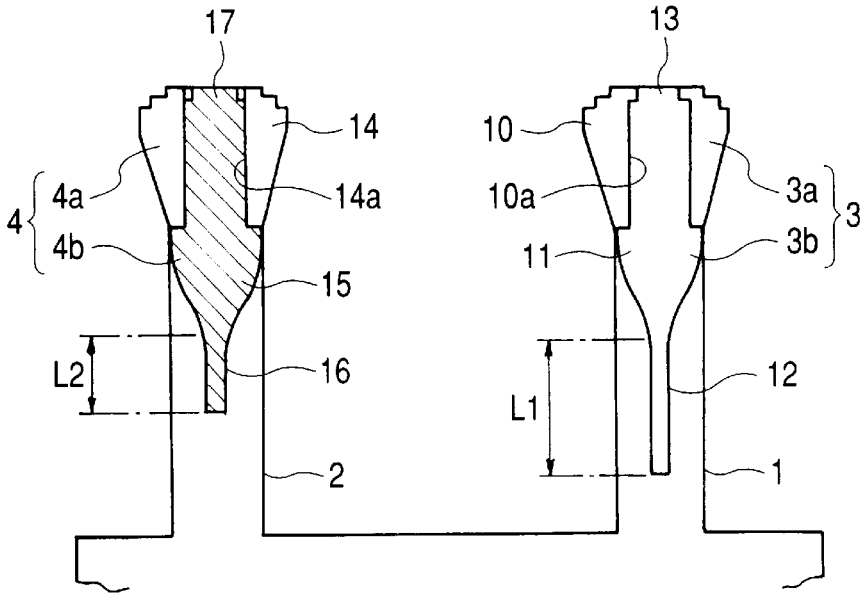
FIG. 9 is a diagram showing the difference between two dielectric feeders.
Figure 10:
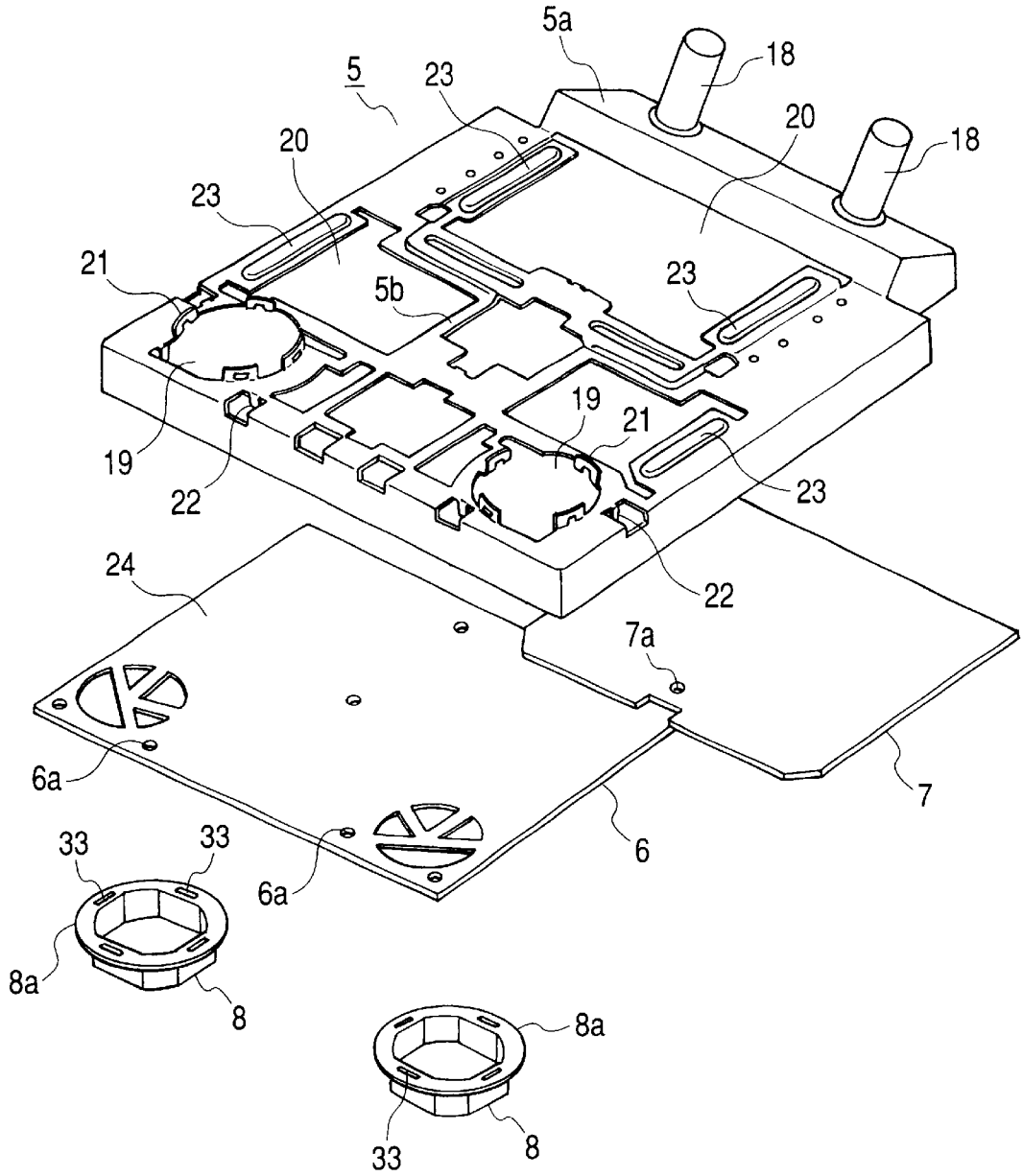
FIG. 10 is an exploded perspective view showing a shield case, a circuit board and a short cap.
Figure 11:
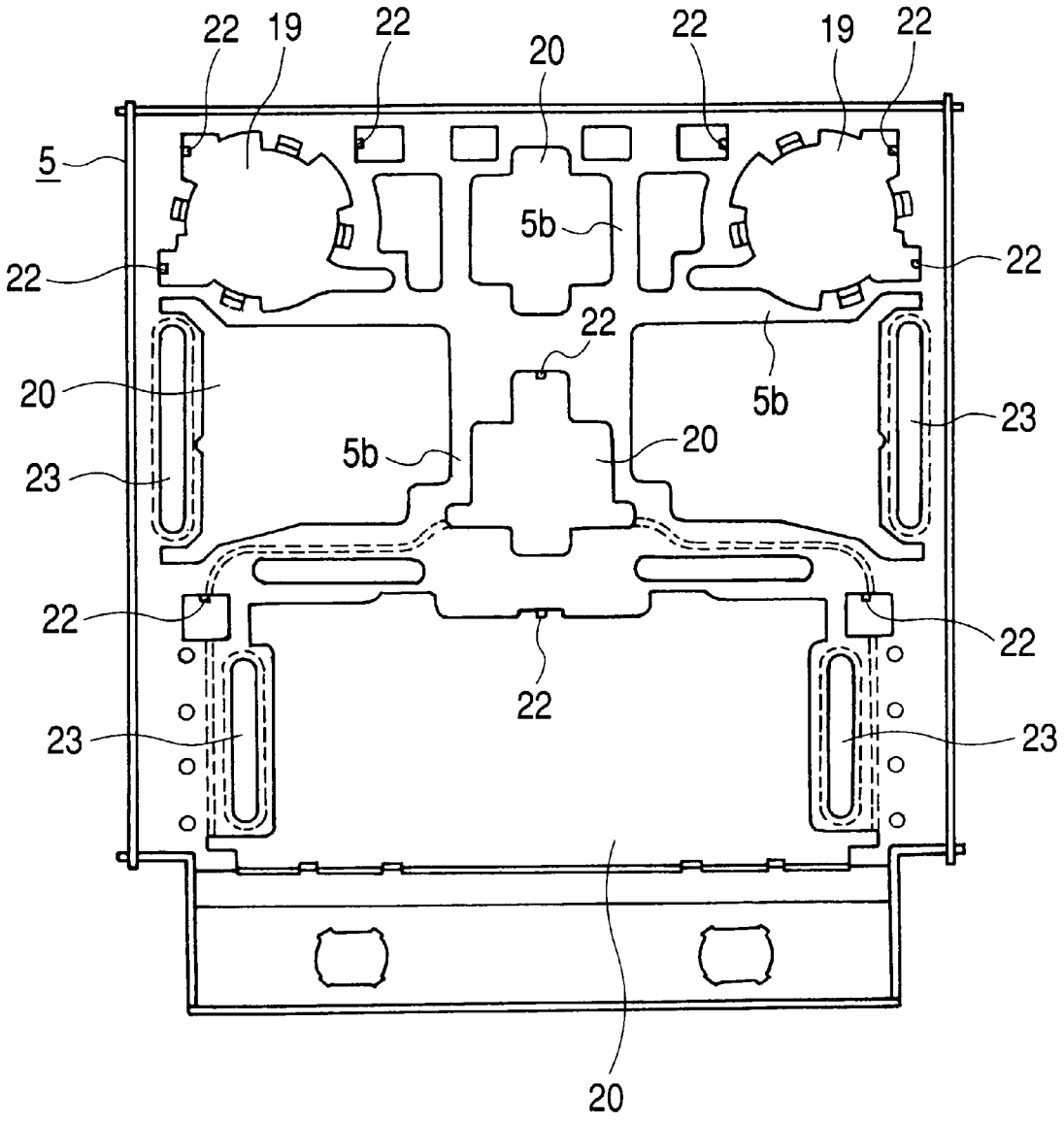
FIG. 11 is a back side view of the shield case.
Figure 12:
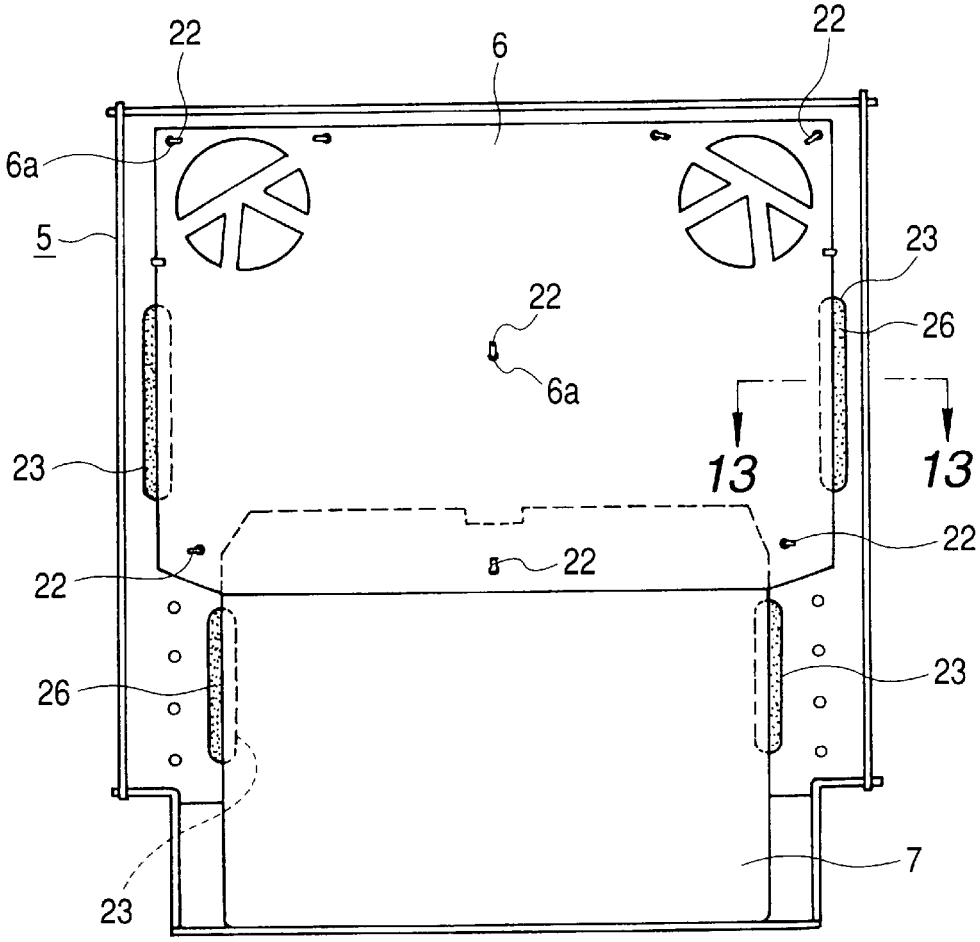
FIG. 12 is a diagram showing a state that the circuit board is fixed to the shield case.
Figure 13:
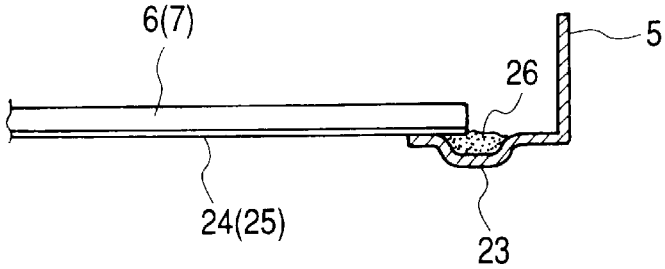
FIG. 13 is a cross-sectional view taken along B—B line of FIG. 12.
Figure 14:
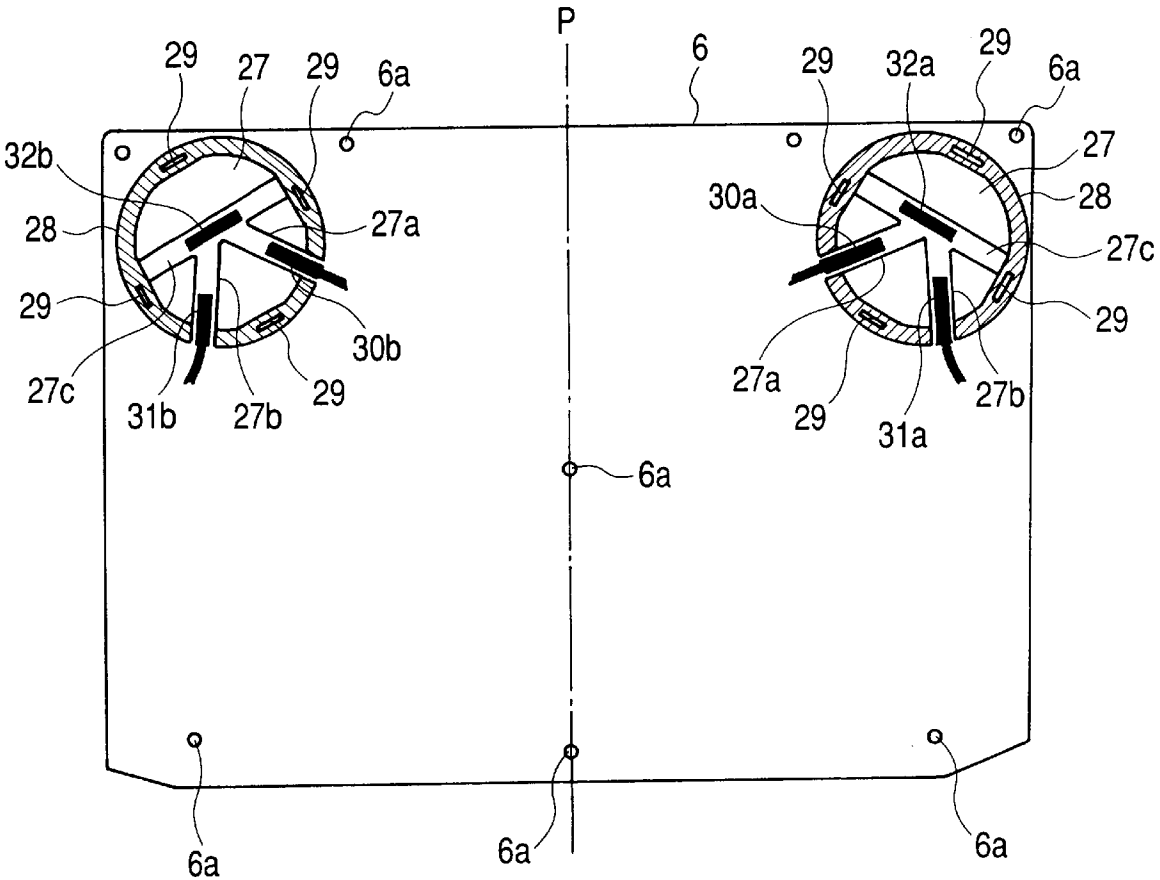
FIG. 14 is a diagram showing a part mounting face of a first circuit board.
Figure 15:
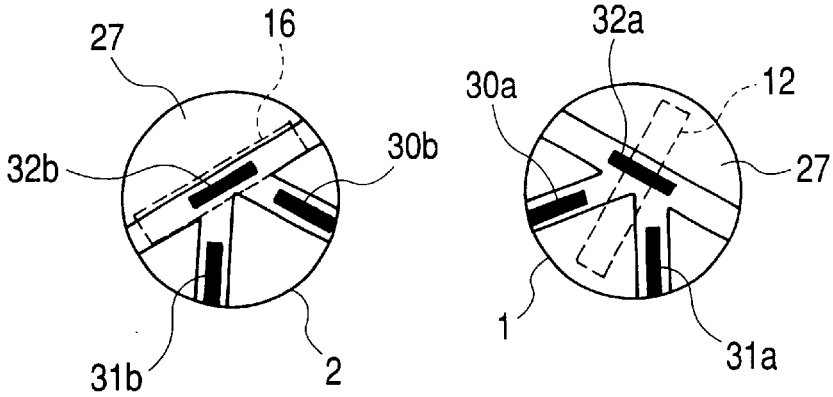
FIG. 15 is a diagram showing the positional relationship between a phase converter of the dielectric feeder and a minute radiation pattern.
Figure 16:
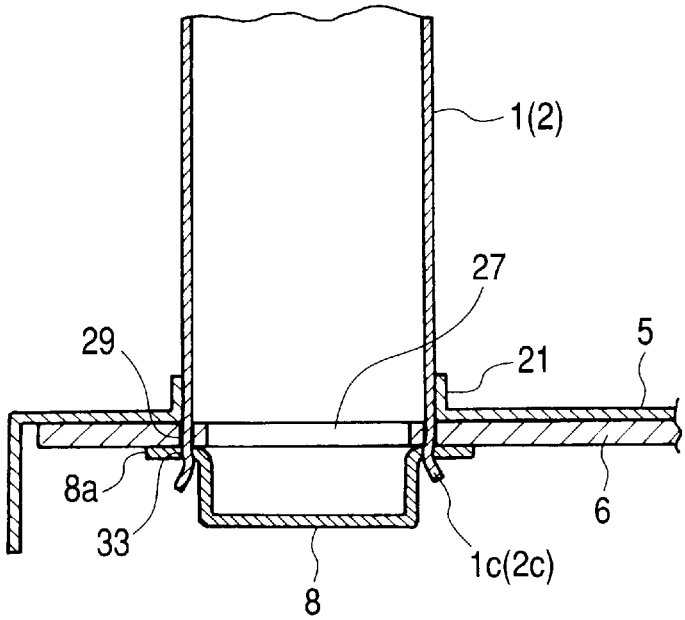
FIG. 16 is a cross-sectional view showing the fixing state of the waveguide, the circuit board and the short cap.
Figure 17:
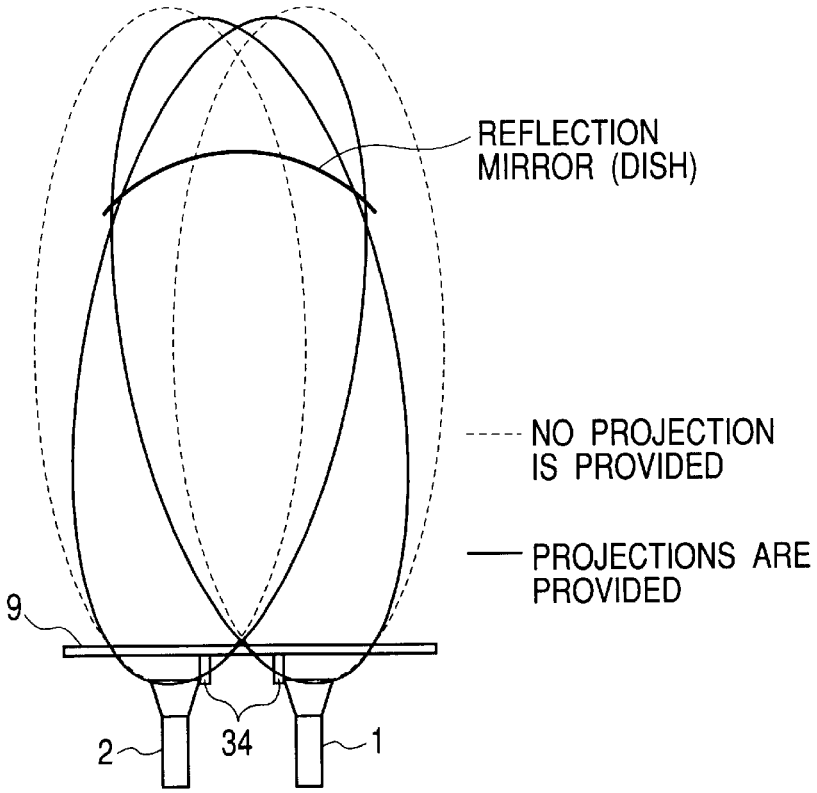
FIG. 17 is a diagram showing the relationship between the correcting portion of a waterproof cover and a radiation pattern.
Figure 18:
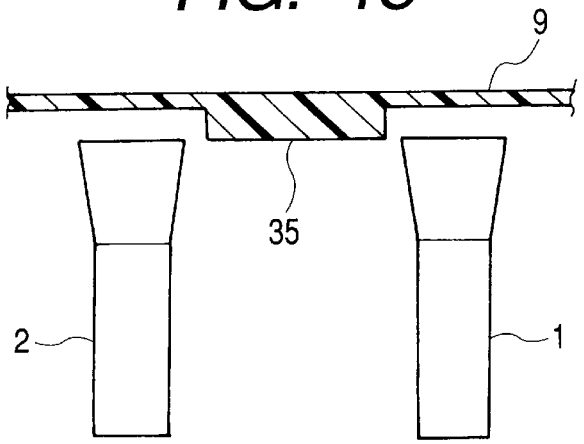
FIG. 18 is a diagram showing a modification of the correcting portion.
Figure 19:
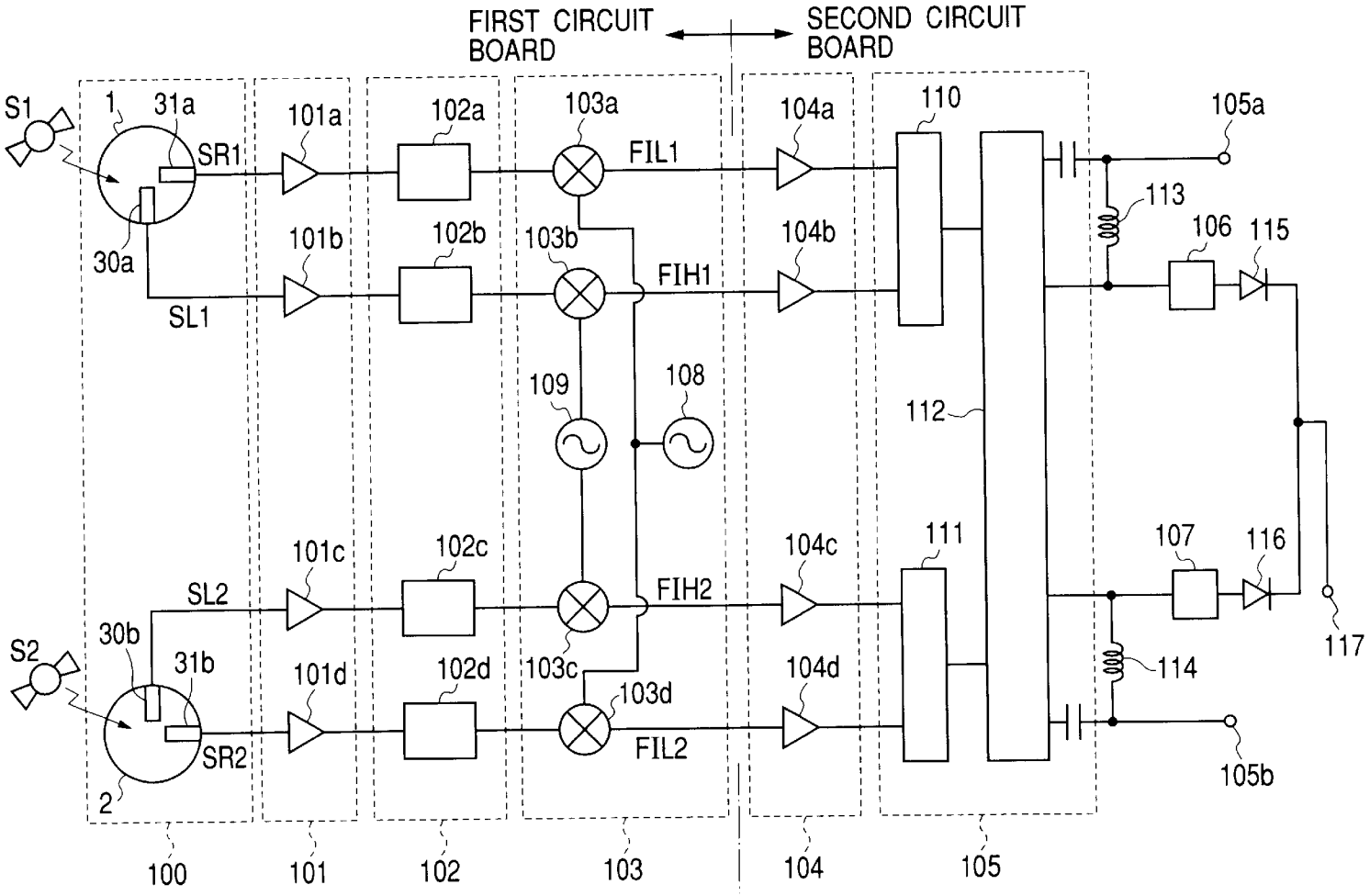
FIG. 19 is a block diagram showing a converter circuit.
Figure 20:
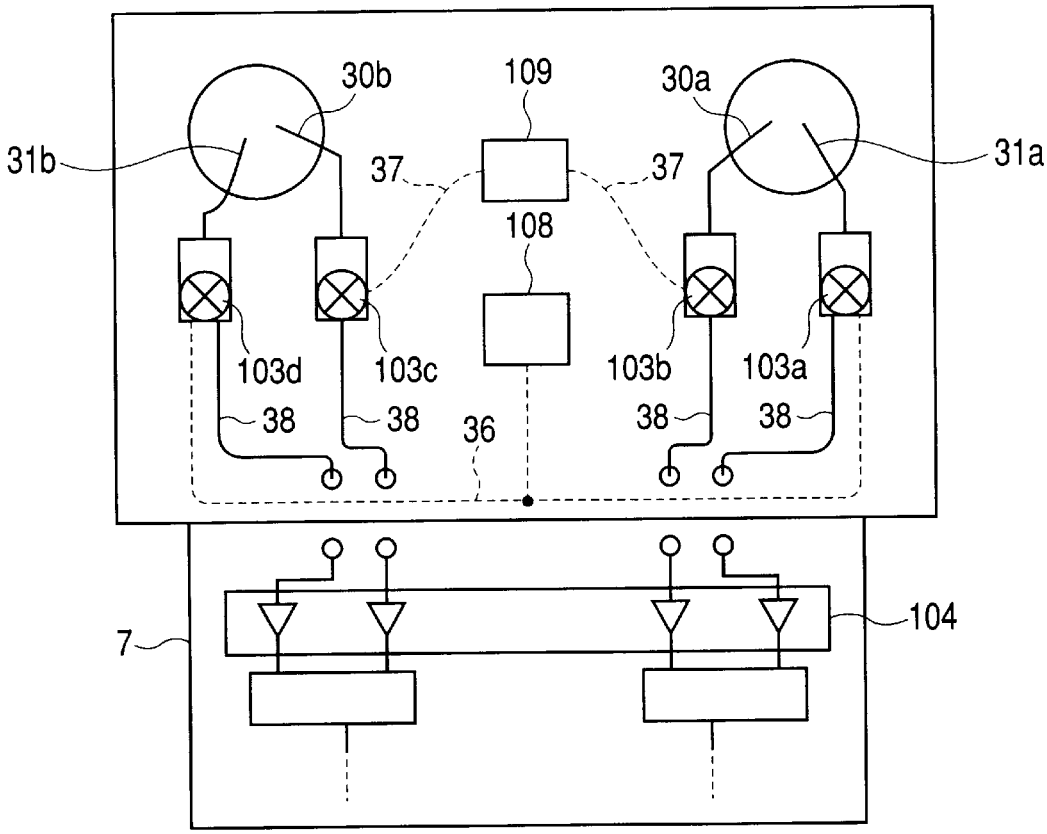
FIG. 20 is a diagram showing a layout state of circuit parts.
Figure 21:
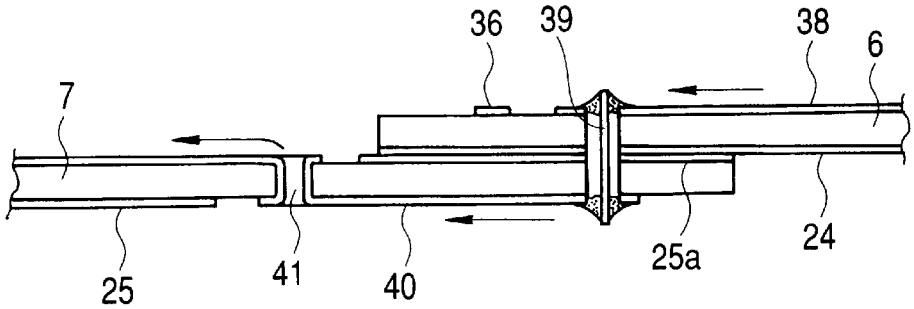
FIG. 21 is an enlarged view showing the joint portion between two circuit boards.

FIG. 1 is a cross-sectional view showing a satellite broadcast reception converter according to an embodiment, FIG. 2 is a cross-sectional view of the satellite broadcast reception converter, which is taken along from another side, FIG. 3 is a perspective view showing a waveguide, FIG. 4 is a front view of the waveguide, FIG. 5 is a perspective view showing a dielectric feeder, FIG. 6 is a front view showing the dielectric feeder, FIG. 7 is a an exploded view of the dielectric feeder, FIG. 8 is a diagram showing the state that the dielectric feeder is fixed to the waveguide, FIG. 9 is a diagram showing the difference between two dielectric feeders, FIG. 10 is an exploded perspective view showing a shield case, a circuit board and a short cap, FIG. 11 is a back-side view of the shield case, FIG. 12 is a diagram showing the state that the circuit board is fixed to the shield case, FIG. 13 is a cross-sectional view taken along A—A line of FIG. 12, FIG. 14 is a diagram showing a part mount face of a first circuit board, FIG. 15 is a diagram showing the positional relationship between a phase converter of the dielectric feeder and a minute radiation patter, FIG. 16 is a cross-sectional view showing the fixing state of the waveguide and the circuit board, the short cap, FIG. 17 is a diagram showing the relationship between a correcting portion of a waterproof cover and a radiation pattern, FIG. 18 is a diagram showing a modification of the correcting portion, FIG. 19 is a block diagram showing a converter circuit, FIG. 20 is a diagram showing a layout state of circuit parts, and FIG. 21 is an enlarged view of the joint portion between two circuit boards.

The satellite broadcast reception converter according to this embodiment comprises first and second waveguides 1, 2, first and second dielectric feeders 3, 4 which are supported at the tip portions of the waveguides 1, 2 respectively, a shield case 5, first and second circuit boards 6, 7 fixed in the shield case 5, a pair of short caps 8 for closing the rear open ends of the respective waveguides 1, 2, a waterproof cover 9 for covering these parts, etc.

As shown in FIGS. 3 and 4, the first waveguide 1 is achieved by rolling a metal flat plate in a cylindrical form and joining the metal flat plate thus rolled, and then fixing the joint portion of the metal flat plate by plural caulking portions 1*a*. The interval between the respective caulking portions 1*a* is set to about a quarter wavelength of the wavelength $\lambda g$ in waveguide. The first waveguide 1 has a substantially circular shape in section, and four parallel portions 1*b* are formed on the peripheral surface thereof so as to be located at angular intervals of about 90 degrees in the peripheral direction. Each parallel portion 1*b* extends in the longitudinal direction parallel to the center axis of the first waveguide 1, and a snap pawl 1*c* is extensively equipped to the rear end of each parallel portion 1*b*. Further, a stopper pawl 1*d* is formed at some midpoint of each of two confronting parallel portions 1*b*, and the stopper pawls 1*d* are disposed to project into the inside of the first waveguide 1. The second waveguide 2 has the entirely same construction as the first waveguide 1. The duplicative description thereof is omitted below, however, it has a caulking portion 2*a*, a parallel portion 2*b*, a snap pawl 2*c* and a stopper pawl 2*d*.

Both the first dielectric feeder 3 and the second dielectric feeder 4 are formed of synthetic resin material having a low dielectric dissipation factor. In this embodiment, polyethylene (dielectric constant $\in \cong 2.25$) which is inexpensive is used in consideration of the price. As shown in FIGS. 5 to 7, the first dielectric feeder 3 is constructed by a first split body 3*a* having a radiation portion 10 and a second split body 3*b* comprising an impedance converter 11 and a phase converter 12. The radiation portion 10 is designed in a conical shape which expands like a horn, and a circular through hole 10*a* is formed at the center portion of the radiation portion 10. An engaging projection 10*b* is equipped on the inner peripheral surface of the through hole 10*a*, and the first split body 3*a* is subjected to mold opening with the engaging projection 10*b* set as a parting line in the injection molding process. Further, an annular groove 10*c* is formed on the end face of the expanded tip portion of the radiation portion 10, and the depth of the annular groove 10*c* is set to about a quarter wavelength of the wavelength $\lambda$ of the electric waves propagating in the annular portion concerned.

The impedance converter 11 has a pair of curved surfaces 11*a* which are narrowed in an arcuate shape toward the phase converter 12, and the cross-sectional shape of each curved surface 11*a* is approximately represented by a quadratic curve. The end face of the impedance converter 11 is substantially circular, and four flat fixing faces 11*b* are formed at an angular interval of about 90 degrees on the peripheral edge of the end face. Further, the impedance converter 11 is equipped with a cylindrical projection 13 at the center of the end face thereof, and an engaging recess portion 13*a* is formed on the outer peripheral surface of the projection 13. When the projection 13 is inserted into the through hole 10*a* to make the end face of the impedance converter 11 abut against the rear end face of the radiation portion 10, the engaging recess portion 13*a* and the engaging projection 10*b* are snap-jointed to each other in the through hole 10*a*, thereby unifying the first split body 3*a* and the second split body 3*b*.

At this time, when the length from the rear end face of the radiation portion 10 to the engaging projection 10*b* is represented by A and the length from the end face of the impedance converter 11 to the engaging recess portion 13*a* is represented by B, the dimension A is set to be slightly longer than the dimension B. Therefore, at the time of the snap-joint between the engaging recess portion 13*a* and the engaging projection 10*b*, there occurs force acting to press the rear end face of the radiation portion 10 against the end face of the impedance converter 11, and the first split body 3*a* and the second split body 3*b* are unified into one body with no rattle. Further, the annular groove 13*b* is formed on the tip face of the projection 13, so that both the annular grooves 10*c* and 13*b* are concentrically arranged at the time when the first split body 3*a* and the second split body 3*b* are unified.

The phase converter 12 is designed to be continuous with the tapered portion of the impedance converter 11, and functions as a 90-degree phase shifter for converting a circularly-polarized wave incident into the first dielectric feeder 3 to a linearly-polarized wave. The phase converter 12 is formed of a plate member having a substantially uniform thickness, and plural notches 12*a* are formed at the tip portion thereof. The depth of each notch 12*a* is set to about a quarter wavelength of the wavelength λg in waveguide, and the end face of the phase converter 12 and the bottom surfaces of the notches 12*a* serve as two reflection faces which are orthogonal to the travel direction of the electric waves. Further, elongated grooves 12*b* are formed on the both the side surfaces of the phase converter 12.

As shown in FIG. 8, the first dielectric feeder 3 thus constructed is supported by the first waveguide 1, the radiation portion 10 of the first split body 3*a* and the projection 13 of the second split body 3*b* are projected from the open end of the first waveguide 1, and the impedance converter 11 and the phase converter 12 of the second splitter 3*b* are inserted and fixed in the first waveguide 1. At this time, the respective fixing faces 11*b* of the impedance converter 11 are press-fitted to the four corresponding parallel portions 1*b* formed on the inner peripheral surface of the first waveguide 1, and also both the side surfaces of the phase converter 12 are press-fitted to the two parallel portions 1*b* which are disposed at an angular interval of 180 degrees so as to face each other, whereby the second split body 3*b* can be simply fixed to the first waveguide 1 with high positional precision. Further, the stopper pawls 1*d* formed on the two parallel portions 1*b* bite into the elongated grooves 12*b* of the phase converter 12, so that the second split body 3*b* can be surely prevented from falling off the first waveguide 1.

The second dielectric feeder 4 has the same basic construction as the first dielectric feeder 3 in that it is constructed by a first split body 4*a* having a radiation portion 14 and a second split body 4*b* comprising an impedance converter 15 and a phase converter 16, and a projection 17 of the second split body 4*b* is inserted and fixed in a through hole 14*a* of the first split body 4*a*, however, it is different from the first dielectric feeder 3 in the following two points. A first difference point resides in that the phase converters 12, 16 are different in length. Comparing the length L1 of the phase converter 12 of the first dielectric feeder 3 and the length L2 of the phase converter 16 of the second dielectric feeder 4, they are set to satisfy the relation of L1>L2. A second difference point resides in that the second split bodies 3*b*, 4*b* are different in color. For example, the second split body 3*b* of the first dielectric feeder 3 is achieved by performing injection molding with the original color of raw material, and the second split body 4*b* of the second dielectric feeder 4 is achieved by performing injection molding after the raw material is colored with red, blue or the like.

That is, among the constituent parts of the first dielectric feeder 3 and the second dielectric feeder 4, both the first split bodies 3*a*, 4*a* are common parts, and both the second split bodies 3*b*, 4*b* are different parts which are different in length and color between the phase converters 12, 16 thereof. The reason why the phase converters 12, 16 are different in length will be described later. If the second split bodies 3*b*, 4*b* are designed to be different in color, erroneous insertion of both the second split bodies 3*b*, 4*b* can be simply and surely checked by viewing the colors of the projections 13, 17 exposed from the end faces of the first split bodies 3*a*, 4*a* when the first and second dielectric feeders 3, 4 are mounted on the corresponding first and second waveguides 1, 2 as shown in FIG. 9.

As shown in FIGS. 10 to 13, the shield case 5 is achieved by subjecting a metal flat plate to press working, and a pair of connectors 18 are secured to a slant surface 5*a* formed at one side portion of the shield case 5. A pair of through holes 19 and plural open holes 20 are formed in the flat top plate of the shield case 5, and plural support portions 21 are formed at the peripheral edge of each through hole 19 having a circular shape and bent toward the outside of the shield case 5 in the vertical direction. Further, plural pier portions 5*b* are formed in the top plate of the shield case 5 so as to be surrounded by the respective open holes 20, and plural fitting pawls 22 are formed at the outer edges of the pier portions 5*b* and bent toward the inside of the shield case 5 in the vertical direction. In addition, plural recess portions 23 are formed on the back surfaces of the pier portions 5*b* of the shield case 5, and the recess portions 23 are formed in an elongated shape along the outer edges of the open holes 20.

A first circuit board 6 is formed of material such as polytetrafluoroethylene or the like of fluorocarbon resin group having a low dielectric constant and a low dielectric loss, and it is designed to be larger in outer shape than the second circuit board 7. Plural through holes 6*a* are formed at suitable positions of the first circuit board 6. The second circuit board 7 is formed of material such as glass-added epoxy resin or the like which has a lower Q-value than the first circuit board 6, and a through hole 7*a* is formed in the second circuit board 7. Each of the first and second circuit boards 6, 7 is provided with a ground pattern 24, 25 atone side thereof, and each ground pattern 24, 25 is soldered to the shield case 5 by using solder 26 filled in each recess portion 23. In this case, if the ground patterns 24, 25 of both the circuit boards 6, 7 are overlaid on the back surface of the top plate of the shield case 5 under the state that cream solder is filled in each recess portion 23 in advance and then the cream solder is melted in a reflow furnace or the like, both the circuit boards 6, 7 can be simply and surely grounded to the shield case 5. At this time, if a part of each recess portion 23 is exposed to the outside from the outer edge portion of each circuit board 6, 7 as shown in FIGS. 12 and 13, defects such as lack of solder, etc. can be easily visually checked, and thus deficient solder can be easily supplemented.

The first and second circuit boards 6, 7 can be not only soldered to the shield case 5, but also fixed to the back surface of the top plate of the shield case 5 by using the respective fitting pawls 22. In this case, if the respective fitting pawls 22 of the shield case 5 are inserted into the respective through holes 6*a*, 7*a* of the circuit boards 6, 7 and then bent toward the plate surface side of the first circuit board 6, both the circuit boards 6, 7 could be fixed to the shield case 5. Particularly, paying attention to the first circuit board 6 which is larger in size than the second circuit board 7, suitable places containing the center portion and the peripheral edge portion are pressed against the back surface of the top plate of the shield case 5 by the plural fitting pawls 22, so that warp of the first circuit board 6 can be surely corrected.

As shown in FIGS. 14 and 15, a pair of circular holes 27 are formed in the first circuit board 6, and first to third bridging portions 27*a* to 27*c* are formed in each circular hole 27. Under the state that the first circuit board 6 is fixed in the shield case 5, both the circular holes 27 are coincident with the respective through holes 19 of the shield case 5. The first bridging portion 27*a* and the second bridging portion 27*b* cross each other at an angle of about 90 degrees, and the third bridging portion 27*c* intersects to both the first and second bridging portions 27*a*, 27*b* at an angle of about 45 degrees. The respective bridging portions 27*a* to 27*c* at the left side of FIG. 14 and the respective bridging portions 27*a* to 27*c* at the right side of FIG. 14 are located to be linearly symmetrical with each other with respect to the line P passing through the center of the first circuit board 6. The opposite side to the ground pattern 24 side of the first circuit board 6 serves as a part-mount surface, and an annular earth pattern 28 is formed around each of the circular holes 27 on the part-mount surface. These earth patterns 28 are conducted to the ground pattern 24 through the through holes, and four fixing holes 29 are formed at angular intervals of about 90 degrees in the circumferential direction in each earth pattern 28. Each fixing hole 29 is designed in a rectangular shape, and the four fixing holes 29 at the left side of FIG. 14 and the four fixing holes 29 at the right side of FIG. 14 are located to be linearly symmetrical with each other with respect to the line P.

On the part-mount surface of the first circuit board 6 are formed a pair of first probes 30*a*, 30*b* located on both the first bridging portions 27*a*, a pair of second probes 31*a*, 31*b* located on both the second bridging portions 27*b* and a pair of minute radiation patterns 32*a*, 32*b* located on both the third bridging portions 27*c* by pattern formation. Accordingly, the respective pairs of the first probes 30*a*, 30*b*, the second probes 31*a*, 31*b* and the minute radiation patterns 32*a*, 32*b* at the right and left sides are located to be linear symmetrical with respect to the line P. In the following description, the minute radiation pattern 32*a* at the right side of FIG. 14 is referred to as a first minute radiation pattern, and the minute radiation pattern 32*b* at the left side of FIG. 14 is referred to as a second minute radiation pattern.

The short cap 8 is achieved by subjecting a metal plate to press working, and a flange portion 8*a* is formed at the open end side having a bottom-present shape as shown in FIG. 10. Four fixing holes 33 are formed in the flange portion 8*a* at angular intervals of about 90 degrees in the circumferential direction, and each fixing hole 33 is designed in a rectangular shape. The short cap 8 functions as an terminal face for closing the open end of the rear portion of each of the waveguides 1, 2, and the short cap 8 and the first, second waveguide 1, 2 are unified through the first circuit board 6 as shown in FIG. 16. That is, the respective snap pawls 1*c*, 2*c* of the first and second waveguides 1, 2 are inserted through the fixing holes 29 of the first circuit board 6 and projected to the back surface side thereof, and the respective fixing holes 33 of the short caps 8 are snapped into the snap pawls 1*c*, 2*c*, whereby the first circuit board 6 is pinched and fixed between the waveguides 1, 2 and the pair of short caps 8. At this time, cream solder is coated on the earth pattern 28 of the first circuit board 6 in advance, and by melting the cream solder in a reflow furnace after the snap-in of the short caps 8, the short caps 8 are soldered to the earth pattern 28 of the first circuit board 6.

As described above, the first circuit board 6 is fixed in the shield case 5, and the first waveguide 1 and the second waveguide 2 are fixed vertically to the first circuit board 6 so as to penetrate from the first circuit board 6 through the through holes 19 of the shield case 5 and project to the outside. In this case, both the waveguides 1, 2 abut against the respective support portions 21 formed at the peripheral edges of the through holes 19, and these support portions 21 prevent undesired deformation such as inclination or the like of the waveguides 1, 2. The open portion of the shield case 5 at the opposite side to the projecting side of the waveguides 1, 2 is covered (not shown).

Returning to FIGS. 1 and 2, the respective parts such as both the waveguides 1, 2, both the dielectric feeders 3, 4, the shield case 5, etc. described above are accommodated in the waterproof cover 9, and the pair of connectors 18 are projected from the waterproof cover 9 to the outside. The waterproof cover 9 is formed of dielectric material having excellent weather resistance such as polypropylene, ASA resin or the like, and the radiation portions 10, 14 of the dielectric feeders 3, 4 are disposed to face the front surface portion 9*a* of the waterproof cover 9. A pair of projecting walls 34 are equipped substantially at the center of the front surface portion 9*a*, and both the projecting walls 34 extend to pass over the gap between the first and second waveguides 1, 2. These projecting walls 34 function as a correcting portion, and they can correct the radiation pattern of the electric waves incident to the waveguides 1, 2 in accordance with the volume ratio of the projecting walls 34 because the phase of electric waves passing through the waterproof cover 9 is delayed by the projecting walls 34. Accordingly, as shown in FIG. 17, the radiation pattern can be corrected from a shape indicated by a broken line (in case of no projecting wall 34) to a shape indicated by a solid line, and thus a miniaturized reflection mirror (dish) is available. A thick portion 35 achieved by making the front surface portion 9*a* of the waterproof cover 9 thicker substantially at the center portion of the front surface portion 9*a* may be used as the correcting portion as shown in FIG. 18 in place of the projecting walls 34.

The satellite broadcast reception converter according to this embodiment receives electric waves transmitted from two adjacent satellites (first satellite S1 and second satellite S2) which have been launched to the sky, and the first and second satellites S1 and S2 respectively transmit left-handed and right-handed circularly-polarized wave signals. The circularly-polarized wave signals are converged by the reflection mirror, pass through the waterproof cover 9 and then are incident into the first and second waveguides 1, 2. For example, the left-handed and right-handed circularly-polarized wave signals transmitted from the first satellite S1 are incident from the end faces of the radiation portion 10 and the projection 13 into the first dielectric feeder 3, and propagate from the radiation portion 10 through the impedance converter 11 to the phase converter 12 in the first dielectric feeder 3. Thereafter, the circularly polarized wave signals are converted to linearly-polarized waves in the phase converter 12, and then incident into the first waveguide 1. That is, the circularly-polarized wave corresponds to the rotating composite vector between two linearly-polarized waves that are equal in amplitude and have a phase difference of 90 degrees therebetween. Therefore, when the circularly-polarized wave propagates in the phase converter 12, the electric waves having the phase difference of 90 degrees are set to be in phase. For example, the left-handed circularly-polarized wave is converted to the vertically-polarized wave, and the right-handed circularly-polarized wave is converted to the horizontally-polarized wave.

At this time, since the plural annular grooves 10*c*, 13*b* having the depth of about λ/4 wavelength are formed on the end face of the first electric feeder 3, the electric waves reflected from the end face of the radiation portion 10 and the bottom surfaces of the annular grooves 10*c*, 13*b* are inverted in phase and canceled, so that the reflection components of the electric waves directing to the end face of the radiation portion 10 are greatly reduced. In addition, since the radiation portion 10 is designed like a horn expanding from the open end of the front side of the first waveguide 1, the electric waves can be efficiently converged to the first dielectric feeder 3 and also the length in the axial line direction of the radiation portion 10 can be shortened.

The impedance converter 11 is equipped between the radiation portion 10 of the first dielectric feeder 3 and the phase converter 12, and the cross-sectional shape of each of the pair of curved surfaces 11*a* formed in the impedance converter 11 is continuously designed by an approximate quadratic curve, whereby the thickness of the first dielectric feeder 3 is converged to gradually decrease from the radiation portion 10 to the phase converter 12. Therefore, not only the reflection components of the electric waves propagating in the first dielectric feeder 3 can be effectively reduced, but also the phase difference to the linearly-polarized wave is increased even when the length of the portion extending from the impedance converter 11 to the phase converter 12 is shortened. From this viewpoint, the overall length of the first dielectric feeder 3 can be also greatly shortened.

Further, since the notches 12*a* having the depth of about λg/4 wavelength are formed on the end face of the phase converter 12, the electric waves reflected from the bottom surfaces of the notches 12*a* and the end face of the phase converter 12 are inverted in phase and canceled, so that impedance mismatch at the end face of the phase converter 12 can be overcome.

The left-handed and right-handed circularly-polarized wave signals transmitted from the first satellite SI are converted to the vertically and horizontally polarized wave signals in the phase converter 12 of the first dielectric feeder 3 as described above, and then travel to the short caps 8 in the first waveguide 1. The vertically-polarized wave is detected by the first probe 30*a*, and the horizontally-polarized wave is detected by the second probe 31*a*. Likewise, the left-handed and right-handed circularly polarized wave signals transmitted from the second satellite S2 travel from the end faces of the radiation portion 14 and the projection 17 into the second dielectric feeder 4, and the left-handed circularly polarized wave is converted to the vertically polarized wave in the phase converter 16 of the second dielectric feeder 4 while the right-handed circularly polarized wave is converted to the horizontally polarized wave. These vertically and horizontally polarized waves travel to the short caps 8 in the second waveguide 1, and the vertically polarized wave is detected by the first probe 30*b* while the horizontally polarized wave is detected by the second probe 31*b*.

Here, the first and second minute radiation patterns 32*a*, 32*b* are formed on the first circuit board 6. Since the first minute radiation pattern 32*a* intersects to each axial line of the first and second probes 30*a*, 31*a* at an angle of about 45 degrees and the second minute radiation pattern 32*b* intersects to each axial line of the first and second probes 30*b*, 31*b* at an angle of about 45 degrees, disturbances of the electrical fields of the vertically polarized wave and the horizontally polarized wave in the waveguides 1, 2 can be suppressed by the first and second minute radiation patterns 32*a*, 32*b* respectively, and isolation between the vertically polarized wave and the horizontally polarized wave can be kept. Further, each of the first and second minute radiation patterns 32*a*, 32*b* is designed in a rectangular shape which is asymmetrical with respect to the axial line of each of the probes 30*a*, 31*a*, 30*b*, 31*b*, and the size (area) thereof is set to a relatively small value. Therefore, the reflection at the first and second minute radiation patterns 32*a*, 32*b* can be reduced with keeping the isolation between the vertically polarized wave and the horizontally polarized wave.

The first and second minute radiation patterns 32*a*, 32*b* are located on the first circuit board 6 so as to be linearly symmetrical with each other with respect to the line P. Therefore, as is apparent from FIG. 15, the first minute radiation pattern 32*a* is substantially orthogonal to the phase converter 12 of the first dielectric feeder 3, and the second minute radiation pattern 32*b* is substantially parallel to the phase converter 16 of the second dielectric feeder 4. In this case, as compared with the electrical field distribution in the second waveguide 2 in which the second minute radiation pattern 32*b* is substantially parallel to the phase converter 16, the electrical field distribution in the first waveguide 1 in which the first minute radiation pattern 32*a* is substantially orthogonal to the phase converter 12 is deteriorated. Therefore, the deterioration of the electrical field distribution is corrected by increasing the dimension in the axial line direction of the phase converter 12. That is, as described above, the length L1 of the phase converter 12 of the first dielectric feeder 3 and the length L2 of the phase converter 16 of the second dielectric feeder 4 are set to satisfy the relationship: L1>L2 (see FIG. 9), that is, the length of the phase converter 12 is set to be longer, thereby preventing occurrence of a phase difference between the linearly-polarized waves traveling in the first waveguide 1.

The reception signals detected by the first probes 30*a*, 30*b* and the second probes 31*a*, 31*b* are frequency-converted to IF frequency signals by a converter circuit mounted on the first and second circuit boards 6, 7 and then output therefrom. As shown in FIG. 19, the converter circuit comprises a satellite broadcast signal input terminal portion 100 for receiving satellite broadcast signals transmitted from the first satellite S1 and the second satellite S2 and leading these signals to subsequently-connected circuits, a reception signal amplifying circuit portion 101 for amplifying and outputting the satellite broadcast signals input, a filter portion 102 for attenuating an image frequency band of the satellite broadcast signals input, a frequency converting portion 103 for frequency-converting the satellite broadcast signals output from the filter portion 102, an intermediate frequency amplifying circuit portion 104 for amplifying the signals output from the frequency converter 103, a signal selecting means 105 for selecting and outputting a satellite broadcast signal amplified by the intermediate frequency amplifying circuit portion 104, first and second regulators 106, 107 for supplying a power voltage to the respective circuit portions such as the reception signal amplifying circuit portion 101, the filter portion 102, the signal selecting means 105, etc.

Satellite broadcast signals of left-handed and right-handed circularly polarized waves of 12.2 GHz to 12.7 GHz are transmitted from the first satellite S1 and the second satellite S2, and these satellite broadcast signals are converged and input to the satellite broadcast signal input terminal portion 100 by the reflection mirror of the outdoor antenna device. The satellite broadcast signal input terminal portion 100 has the first and second probes 30*a*, 31*a* for detecting the left-handed and right-handed circularly polarized wave signals transmitted from the first satellite S1 and the first and second probes 30*b*, 31*b* for detecting the left-handed and right-handed circularly polarized wave signals transmitted from the second satellite S2. As described above, the left-handed and right-handed circularly polarized wave signals transmitted from the first satellite S1 are converted to the vertically polarized wave and the horizontally polarized wave and detected by the first and second probes 30*a*, 31*a*. The first probe 30*a* outputs a left-handed circularly-polarized wave signal SL1, and the second probe 31*a* outputs a right-handed circularly-polarized wave signal SR1. The left-handed and right-handed circularly polarized waves transmitted from the second satellite S2 are converted to the vertically polarized wave and the horizontally polarized wave and then detected by the first and second probes 30*b*, 31*b* respectively. The first probe 30*b* outputs a left-handed circularly-polarized wave signal SL2, and the second probe 31*b* outputs a right-handed circularly polarized wave signal SR2.

The reception signal amplifying circuit portion 101 has first to fourth amplifiers 101*a*, 101*b*, 101*c*, 101*d*. The first amplifier 101*a* receives the right-handed circularly-polarized wave signal SR1, the second amplifier 101*b* receives the left-handed circularly-polarized wave signal SL1, the third amplifier 101*c* receives the left-handed circularly-polarized wave signal SL2 and the fourth amplifier 101*d* receives the right-handed circularly-polarized wave signal SR2 to amplify these signals up to a desired level and output them to the filter portion 102.

The filter portion 102 has first to fourth band eliminating filters 102*a*, 102*b*, 102*c*, 102*d*. The first and fourth band eliminating filters 102*a* and 102*d* attenuate the frequency band of 9.8 GHz to 10.3 GHz which corresponds to the image frequency bands of the first intermediate frequency signal FIL1 and the fourth intermediate frequency signal FIL2, and the second and third band eliminating filters 102*b*, 102*c* attenuate the frequency band of 16.0 GHz to 16.5 GHz which corresponds to the image frequency bands of the second intermediate frequency signal FIH1 and the third intermediate frequency signal FIH2. After the right-handed circularly-polarized wave signal SR1 passes through the first band eliminating filter 102*a*, the left-handed circularly-polarized wave signal SL1 passes through the second band eliminating filter 102*b*, the left-handed circularly-polarized signal SL2 passes through the third band eliminating filter 102*c* and the right-handed circularly-polarized wave signal SR2 passes through the fourth band eliminating filter 102*d*, these signals are led to the frequency converter 103.

The frequency converter 103 has first to fourth mixers 103*a*, 103*b*, 103*c*, 103*d*, a first oscillator 108 and a second oscillator 109. The first oscillator 108 (oscillation frequency=11.25 GHz) is connected to the first mixer 103*a* and the fourth mixer 103*d*. The satellite broadcast signal output from the first band eliminating filter 102*a* is frequency-converted to the first intermediate frequency signal FIL1 of 950 MHz to 1450 MHz in the first mixer 103*a*, and the satellite broadcast signal output from the fourth band eliminating filter 102*d* is frequency-converted to the fourth intermediate frequency signal FIL2 of 950 MHz to 1450 MHz in the fourth mixer 103*d*. The second oscillator 109 (oscillation frequency=14.35 GHz) is connected to the second mixer 103*b* and the third mixer 103*c*. The satellite broadcast signal output from the second band eliminating filter 102*b* is frequency-converted to the second intermediate frequency signal FIH1 of 1650 MHz to 2150 MHz in the second mixer 103*b*, and the satellite broadcast signal output from the third band eliminating filter 102*c* is frequency-converted to the third intermediate frequency signal FIH2 of 1650 MHz to 2150 MHz in the third mixer 103*c*.

The intermediate frequency amplifying circuit portion 104 has first to fourth intermediate frequency amplifiers 104*a*, 104*b*, 104*c*, 104*d* which respectively receive the first to fourth intermediate frequency signals output from the frequency converter 103 to amplify the intermediate frequency signals to predetermined level, and outputs the signals thus amplified to the signal selecting means 105. That is, the first intermediate frequency signal FIL1 is input to the first intermediate frequency amplifier 104*a*, the second intermediate frequency signal FIH1 is input to the second intermediate amplifier 104*b*, the third intermediate frequency signal FIH2 is input to the third intermediate frequency amplifier 104*c* and the fourth intermediate frequency signal fIL2 is input to the fourth intermediate frequency amplifier 104*d*, and the output signals therefrom are led to the signal selecting means 105.

The signal selecting means 105 includes first and second composite circuits 110, 111 and a signal switching control circuit 112. The first signal composite circuit 110 combines the first intermediate frequency signal FIL1 and the second intermediate frequency signal input thereto with each other and leads the composite signal to the signal switching control circuit 112. Likewise, the second signal composite circuit 111 combines the third intermediate frequency signal FIH2 and the fourth intermediate frequency signal FIL1 input thereto with each other and leads the composite signal to the signal switching control circuit 112. The signal switching control circuit 112 selects one of the composite signal of the first intermediate frequency signal FIL1 and the second intermediate frequency signal FIH1 and the composite signal of the third intermediate frequency signal FIH2 and the fourth intermediate frequency signal FIL2, and outputs the composite signal thus selected to the first output terminal 105*a* and the second output terminal 105*b*, respectively. This switching control will be described later.

The first and second output terminals 105*a*, 105*b* are connected to different satellite broadcast receiving TV sets (not shown), and a control signal for controlling the signal selecting means 105 and a voltage for operating each circuit portion are supplied from each of the satellite broadcast receiving TV sets. For example, superposition of a control signal of 22 kHz on a DC voltage of 15V discriminates selection of the composite signal of the intermediate frequency signals FIL1 and FIH1 or the composite signal of the intermediate frequency signals FIL2 and FIH2. That is, the satellite broadcast receiving TV sets supply the control signals to be superposed on the supply voltage to the output terminals 105*a*, 105*b* when selecting reception of the right-handed circularly-polarized wave signal SR1 and the left-handed circularly-polarized wave signal SL1 transmitted from the first satellite S1 or reception of the right-handed circularly-polarized wave signal SR2 and the left-handed circularly-polarized wave signal SL2 transmitted from the second satellite S2. These voltages are input from the first output terminal 105*a* through a high-frequency preventing choke coil 113 to the signal switching control circuit 112, and likewise the voltages are input from the second output terminal 105*b* through a high-frequency preventing choke coil 114 to the signal switching control circuit 112.

The first voltage and the second voltage are input through the high-frequency preventing choke coils 113 and 114 to first and second regulators 106, 107 respectively, and the first and second regulators 106, 107 supplies the power voltage (for example, 8V) to the respective circuit portions. Therefore, the first and second regulators 106, 107 are designed in the same construction, and a voltage stabilizing circuit is constructed by an integrated circuit. The output terminals of the first and second regulators 106, 107 are connected through backflow preventing diodes 115, 116 to the power supply voltage output terminal 117. Accordingly, even when only one of the satellite broadcast receiving TV sets operates, the power supply voltage is supplied to the respective circuit portions. Further, the first and second output terminals 105*a*, 105*b* are connected through the regulators 106, 107 to the power supply voltage output terminal 117 respectively, and thus for example the control signal supplied from the first output terminal 105*a* is prevented from being input to the signal switching control circuit 112 by using the inter-element isolation of the first and second regulators 106, 107. Likewise, the control signal supplied from the second output terminal 105*b* is prevented from being input to the signal switching control circuit 112.

As shown in FIG. 20, the constituent parts for RF circuitry at the front stage from the frequency converter 103 are mounted on the first circuit board 6 while the constituent parts for IF circuitry at the rear stage from the intermediate frequency amplifying circuit portion 104 are mounted on the second circuit board 7, and the first circuit board 6 and the second circuit board 7 are partially overlapped with each other and jointed integrally with each other.

In this case, signal lines for the right-handed circularly-polarized wave signals SR1, SR2 of the first satellite S1 and the second satellite S2 are laid out at the outermost side of the first circuit board 6, and signal lines for the left-handed circularly-polarized wave signals SL1, SL2 of the first satellite S1 and the second satellite S2 are laid out at the inner side of the layout of the former signal lines. The right-handed circularly-polarized wave signals SR1, SR2 at the outside are frequency-converted to the first and fourth intermediate frequency signals FIL1, FIL2 of 950 MHz to 1450 MHz by the first and fourth mixers 103*a*, 103*d* connected to the first oscillator 108, and the left-handed circularly-polarized wave signals SL1, SL2 at the inside are frequency-converted to the second and third intermediate frequency signals FIH1, FIH2 of 1650 MHz to 2150 MHz by the second and third mixers 103*b*, 103*c* connected to the second oscillator 109. That is, the first oscillator 108 and the second oscillator 109 are arranged at the center portion of the first circuit board 6, and the first oscillator 108 is connected through an oscillation signal line 36 to the first mixer 103*a* and the fourth mixer 103*d* at the outside while the second oscillator 109 is connected through an oscillation signal line 37 to the second mixer 103*b* and the third mixer 103*c* at the inside.

As shown in FIG. 21, intermediate frequency signal lines 38 for the intermediate frequency wave signals FIL1, FIL2, FIH1, FIH2 output from the respective mixers 103*a* to 103*d* on the first circuit board 6 are connected to the intermediate frequency amplifying circuit portion 104 on the second circuit board 7 through connection pins 39, and the ground pattern 24 formed on the first circuit board 6 and the ground pattern 25*a* formed on the part-mounting face of the second circuit board 7 are brought into contact with each other at the overlap portion between the first circuit board 6 and the second circuit board 7. A lead pattern 40 confronting the ground pattern 25*a* is formed on the second circuit board 7, the lead pattern 40 is connected to the intermediate frequency amplifying circuit portion 104 of the second circuit board 7 through a through hole 41, and the connection pin 39 is soldered to the intermediate frequency signal line 38 and the lead pattern 40 at both the ends thereof. Accordingly, the oscillation signal line 36 for connecting the first oscillator 108 to the first and fourth mixers 103*a*, 103*d* at the outside and the intermediate frequency signal lines 38 for leading the intermediate frequency signals FIL1 to FIL4 from the respective mixers 103*a* to 103*d* to the intermediate frequency amplifying circuit portion 104 can be intersected to each other at the overlap portion between the first circuit board 6 and the second circuit board 7 with keeping the ground.

According to the satellite broadcast reception converter of the above-described embodiment, the respective snap pawls 1*c*, 2*c* formed at the open ends of the first and second waveguides 1, 2 are inserted into the respective fixing holes 29 of the first circuit board 6, and the respective fixing holes 33 of the short caps 8 are snapped into the snap pawls 1*c*, 2*c*. Therefore, the first circuit board 6 can be pinched and fixed between the waveguides 1, 2 and the short caps 8 through the simple work of fixing the short caps 8 to the snap pawls 1*c*, 2*c* by utilizing characteristic of springs (spring elasticity) of the waveguides 1, 2 formed of sheet metal. Therefore, as compared with the conventional technique of fixing a circuit board and a short cap in a shield case by using plural screws, the number of parts and the number of working steps can be greatly reduced, so that the manufacturing cost of the satellite broadcast reception converter can be reduced. Further, cream solder is coated on the earth pattern 28 of the first circuit board 6 in advance, and the cream solder is melted under the state that the short caps 8 are snapped into the snap pawls 1*c*, 2*c* and temporarily fixed. Therefore, the short caps 8 can be simply soldered to the earth pattern 28 of the first circuit board 6.

Further, the parallel portions 1*b*, 2*b* extending in the axial line direction are formed at four confronting places on the peripheral surface of the waveguides 1, 2, and the snap pawls 1*c*, 2*c* are extensively formed at the tips of the respective parallel portions 1*b*, 2*b*. Therefore, the snap pawls 1*b*, 2*b* can be inserted in the corresponding fixing holes 29 of the first circuit board 6 with no rattle, and the relative positioning between each of the probes 30*a*, 30*b*, 31*a*, 31*b* formed on the first circuit board 6 and the waveguide 1, 2 can be surely performed.

Further, the first circuit board 6 is fixed in the shield case 5, and the waveguides 1, 2 are inserted in the through holes 19 formed in the shield case 5 so as to project to the outside, so that the waveguides 1, 2 and the shield case 5 which are different parts can be unified into one body through the first circuit board 6. Therefore, the waveguides 1, 2 to which high dimensional precision is required can be separated from the shield case 5, and the management of the dimensional precision of the waveguides 1, 2 can be enhanced. In this case, the support portions 21 are formed and bent at the peripheral edge of the through holes 19 of the shield case 5, and the base portions of the waveguides 1, 2 abut against the support portions 21, so that undesired deformation such as inclination of the waveguides 1, 2 or the like can be prevented by the support portions 21.

In the above embodiment, the converter having the first and second waveguides 1, 2 for receiving two satellite broadcasts is described. However, it is needless to say that the present invention is applicable to a converter having one waveguide for receiving one satellite broadcast.

Further, according to the satellite broadcast reception converter of the above-described embodiment, the dielectric feeder 3, 4 formed of synthetic resin supported on the waveguide 1, 2 is constructed by the first split body 3*a*, 4*a* having the radiation portion 10, 14 projected from the open end of the waveguide 1, 2, and the second split body 3*b*, 4*b* having the phase converter 12, 16 fixed in the waveguide 1, 2, and the first split body 3*a*, 4*a* and the second split body 3*b*, 4*b* are unified into one body by inserting the projection 13, 17 of the second split body 3*b*, 4*b* into the through hole 10*a*, 14*a* formed at the center of the first split body 3*a*, 4*a*. Therefore, the volume (volumetric capacity) of each of the first split body 3*a*, 4*a* and the second split body 3*b*, 4*b* as a single body can be reduced, so that occurrence of surface sink and bubbles can be suppressed. In addition, the dielectric feeder 3, 4 is divided at the joint portion between the through hole 10*a*, 14*a* and the projection 13, 17, and the dividing face is located at a position far away from the center of the first split body 3*a*, 4*a* at which the electric field intensity is largest, so that the electrical adverse effect caused by the division can be suppressed.

The second split body 3*b*, 4*b* is equipped with the impedance converter 11, 15 which is narrowed in an arcuate shape from the open end of the waveguide 1, 2 to the phase converter 12, 16, the projection 13, 17 is provided on the end face of the impedance converter 11, 15, and the first split body 3*a*, 4*a* and the second split body 3*b*, 4*b* are jointed to each other at the end face of the impedance converter 11, 15. Therefore, the reflection components of the electric waves propagating from the radiation portion 10, 14 through the impedance converter 11, 15 to the phase converter 12, 16 can be greatly reduced. In addition, the phase difference to the linearly polarized wave is large even when the length of the portion extending from the impedance converter 11, 15 to the phase converter 12, 16 is shortened, so that the overall length of the waveguide 1, 2 can be greatly shortened.

With respect to the first dielectric feeder 3, the engaging projection 10*b* is formed on the inner wall surface of the through hole 10*a* and the engaging recess portion 13*a* is formed on the outer wall surface of the projection 13 so that the engaging projection 10*b* and the engaging recess portion 13*a* are snap-jointed to each other. The snap-joint is also used for the second dielectric feeder 4. Therefore, even when there is somewhat dimensional dispersion between the projection 13, 17 and the through hole 10*a*, 14*a*, both can be simply and surely jointed to each other. At this time, with respect to the first dielectric feeder 3, representing the length from the rear end face of the radiation portion 10 to the engaging projection 10*b* by A and representing the length from the end face of the impedance converter 11 to the engaging recess portion 13*a* by B, the relationship of A>B is set, so that the engaging projection 10*b* and the engaging recess portion 13*a* can be surely snap-jointed to each other with no rattle. It is true of the second dielectric feeder 4.

Further, the radiation portion 10, 14 is designed in a conical shape which expands forwardly from the open end of the waveguide 1, 2, and the end face of the impedance converter 11, 15 is jointed to the rear end face of the radiation portion 10, 14. Therefore, the dividing face vertical to the travel direction of the electric waves propagating in the dielectric feeder 3, 4 can be reduced, and the reflection of the electric waves at the dividing face can be suppressed.

In the above-described embodiment, the description is made on the two-satellite-broadcast reception converter having the first and second waveguides 1, 2 and the first and second dielectric feeders 3, 4. However, it is needless to say that the present invention is applicable to a one-satellite-broadcast reception converter having one waveguide and one dielectric feeder mounted therein.

According to the present invention, the following effects can be achieved.

First, the snap pawls are formed at the open end of the waveguide formed of sheet metal, the snap pawls are inserted in the fixing holes formed in the circuit board, and the short cap for closing the open end of the waveguide is fixed to the snap pawls, whereby the circuit board is pinched and fixed between the waveguide and the short cap. Therefore, the number of parts and the number of working steps can be greatly reduced, so that the manufacturing cost of the satellite broadcast reception converter can be reduced.

Secondly, the dielectric feeder of synthetic resin is constructed by the first split body having the radiation portion projected from the open end of the waveguide and the second split body having the phase converter fixed in the waveguide, and the first and second split bodies are unified by inserting the projection equipped to the second split body into the through hole formed at the center of the first split body. Therefore, the volume (volumetric capacity) of each of the first and second split bodies as a single body can be reduced, so that occurrence of surface sink and bubbles can be reduced. In addition, the dielectric feeder is divided at the joint portion between the through hole and the projection, and the dividing face thereof is located at a position far away from the center of the first split body at which the electric field intensity is largest, so that the electrical adverse effect caused by the division can be suppressed.

What is claimed is:

1. A satellite broadcast reception converter, comprising:

a circuit board having at least one probe;

at least one waveguide formed of sheet metal disposed vertically to said circuit board; and at least one short cap having a bottom for closing an open end of said waveguide, wherein said waveguide is equipped with snap pawls at the open end thereof and said circuit board has fixing holes formed therein, said snap pawls being inserted into said fixing holes of said circuit board to thereby fix said short cap to said snap pawls, whereby said circuit board is pinched and fixed between said waveguide and said short cap.

2. The satellite broadcast reception converter according to claim 1, wherein said short cap is soldered to an earth pattern formed on said circuit board.

3. The satellite broadcast reception converter according to claim 1, wherein said waveguide is equipped with parallel portions extending in an axial line direction of said waveguide at four confronting positions on a peripheral surface of said waveguide, and said snap pawls are respectively formed at tip portions of said parallel portions.

4. The satellite broadcast reception converter according to claim 1, further comprising a shield case having a through hole for accommodating said circuit board and said short cap, wherein said waveguide is inserted through said through hole formed in said shield case to project to an outside of said shield case, and said circuit board is fixed in said shield case.

5. The satellite broadcast reception converter according to claim 4, wherein said shield case is formed of sheet metal, and equipped with support portions for supporting a peripheral surface of said waveguide, said support portion being formed and bent at a peripheral edge of said through hole.

6. A satellite broadcast reception converter, comprising:

at least one waveguide that is closed at one end thereof and opened at another end thereof;

at least one probe projecting in a center axis direction of said waveguide; and at least one dielectric feeder that is supported by said waveguide and formed of synthetic resin, wherein said dielectric feeder comprises a first split body having a radiation portion projecting from the open end of said waveguide and a second split body having a phase conversion portion fixed in said waveguide, and a projection equipped to said second split body is inserted in a through hole formed at a center portion of said first split body to unify said first split body and said second body into one body.

7. The satellite broadcast reception converter according to claim 6, wherein said second split body is equipped with an impedance converter which is narrowed in an arcuate shape from the open end of said waveguide to said phase converter, said projection is equipped to an end face of said impedance converter and said first and second split bodies are jointed to each other at the end face of said impedance converter.

8. The satellite broadcast reception converter according to claim 7, wherein an engaging projection is formed on an inner wall surface of said through hole, and an engaging recess portion is formed on an outer wall surface of said projection, said engaging projection and said engaging recess portion being snap-jointed to each other.

9. The satellite broadcast reception converter according to claim 8, wherein when a length from a rear end face of said radiation portion to said engaging projection is represented by A and a length from the end face of said impedance converter to said engaging recess portion is represented by B, A and B are set to satisfy the relation of A>B.

10. The satellite broadcast reception converter according to claim 7, wherein said radiation portion is designed in a conical shape which expands from the open end of said waveguide, and the end face of said impedance converter is jointed to a rear end face of said radiation portion.

* * * * *